US006792625B2

(12) United States Patent
Hexels

(10) Patent No.: US 6,792,625 B2
(45) Date of Patent: Sep. 21, 2004

(54) PROTECTIVE SUIT FOR PROTECTION AGAINST HARMFUL CHEMICAL AND BIOLOGICAL SUBSTANCES

(75) Inventor: Gerd Hexels, Nettetal (DE)

(73) Assignee: Texplorer GmbH, Nettetal (DE)

( * ) Notice: Subject to any disclaimer, the term of this patent is extended or adjusted under 35 U.S.C. 154(b) by 0 days.

(21) Appl. No.: 10/283,408

(22) Filed: Oct. 29, 2002

(65) Prior Publication Data

US 2003/0135916 A1 Jul. 24, 2003

(30) Foreign Application Priority Data

Nov. 2, 2001 (DE) ..... 101 54 029

(51) Int. Cl.[7] ..... A41D 13/00
(52) U.S. Cl. ..... 2/457
(58) Field of Search ..... 2/457, 69, 81, 2/82, 97, 243.1, 79, 456, 458, 2.17, 78.3, 167, 69.5, 93, 94, 901

(56) References Cited

U.S. PATENT DOCUMENTS

| | | | | | |
|---|---|---|---|---|---|
| 3,516,404 A | | 6/1970 | Spross | 128/142.5 |
| 4,223,064 A | * | 9/1980 | Ballif et al. | 442/234 |
| 4,502,153 A | * | 3/1985 | Lapedes et al. | 2/81 |
| 4,583,247 A | * | 4/1986 | Fingerhut et al. | 2/69 |
| 4,829,603 A | * | 5/1989 | Schnoor et al. | 2/69 |
| 5,119,515 A | * | 6/1992 | Altinger | 2/457 |
| 5,264,276 A | * | 11/1993 | McGregor et al. | 442/289 |
| 5,743,775 A | | 4/1998 | Baurmeister | |
| 6,047,413 A | * | 4/2000 | Welchel et al. | 2/457 |

FOREIGN PATENT DOCUMENTS

| | | | |
|---|---|---|---|
| DE | 1 002 631 | 2/1957 | A62B/29/12 |
| DE | 201 10 132.7 | 6/2001 | |
| EP | 0 157 140 A1 | 10/1985 | A41D/13/00 |
| EP | 0 233 995 A1 | 9/1987 | A62B/17/00 |
| EP | 0 807 515 A2 | 11/1997 | B32B/5/24 |
| EP | 0 906 730 A2 | 4/1999 | A41D/13/02 |
| GB | 1038968 | 8/1966 | |

* cited by examiner

*Primary Examiner*—Tejash Patel
(74) *Attorney, Agent, or Firm*—Davis & Bujold, P.L.L.C.

(57) ABSTRACT

A protective suit for protection against harmful chemical and biological substances, comprising an outer and a liner which is disposed underneath the outer and is provided with a barrier layer against chemical and biological substances. The protective suit is configured as an coverall, the barrier layer which has been incorporated into the liner being a membrane which is surrounded on both sides by a protective layer each.

27 Claims, 1 Drawing Sheet

PROTECTIVE SUIT FOR PROTECTION AGAINST HARMFUL CHEMICAL AND BIOLOGICAL SUBSTANCES

FIELD OF THE INVENTION

The invention relates to a protective suit for protection against harmful chemical and biological substances as classified in the preamble of claim 1.

BACKGROUND OF THE INVENTION

Persons who, in the event of accidents involving harmful substances, work on site and therefore are exposed to these substances have to wear protective suits which stop the harmful substances from getting through to the skin or underwear.

The same is true of the military field when chemical or biological warfare agents are used.

From commercial practice there are known for this purpose two-part protective suits consisting of a jacket and a pair or trousers, each constructed of an outer and a liner into which a carbon-based layer has been introduced. The substances adsorb onto the carbon surface. However, it is disadvantageous in this connection that the carbon will take up a multiplicity of chemicals, including chemicals which are relatively harmless, such as, for example, exhaust gases, deodorants, insect repellents and the like, and hence will become saturated, and consequently pervious, over time. Another problem here is the protective effect against chemicals in the liquid state.

A protective effect, moreover, presupposes a certain layer thickness for the carbon, which not only creates an adverse thermal effect through a heat build-up for the wearer, but also makes the protective suit relatively cumbersome and heavy. In addition, it takes several minutes to put on the two-part protective suit and seal it, which likewise represents an appreciable disadvantage in the event of danger threatening.

The present invention therefore has for its object to provide a protective suit which is simpler to handle and safer in use.

SUMMARY OF THE INVENTION

According to the invention, this object is achieved by the features recited in the characterizing part of claim 1.

Instead of a bulky barrier layer of charcoal, the barrier layer which is used now is a membrane which is surrounded by a protective layer on both sides. The protective layer on the outside serves as a mechanical protector for the membrane and the inner protective layer also serves to increase the wear comfort. To this end, for example, the outer protective layer can be formed of breathable polyester. The inner protective layer can consist of polyamide which can be hydrophilicized in order that it may readily absorb perspiration and transport it to the outside. In an advantageous execution of the invention, the membrane is likewise configured to be breathable. A very useful membrane has been determined to be a cellulose-based material. Such a material is described in U.S. Pat. No. 5,743,775 for example.

The configuration as an coverall facilitates and appreciably speeds the putting on of the suit, since distinctly fewer locations have to be sealed. A membrane, unlike a charcoal layer, can be selectively impervious to harmful substances, while being otherwise pervious. A cellulose-based membrane blocks off a multiplicity of harmful chemicals. Moreover, no saturation occurs and at the same time protection is also provided against chemicals in the liquid state or else as an aerosol and not just protection against gas.

The pressure difference on both sides of the membrane ensures that moisture is transported away from the body, so that there is no heat build-up for the person who is wearing the protective suit. In addition, the evaporation processes which take place ensure a cooling effect.

The execution of the protective suit as an coverall provides a suit which is complete in itself, it then merely being necessary to make connecting pieces to a protective mask and to gloves.

In a very advantageous execution of the invention, the coverall is provided with a hood which is integrated in and hence is integral with the coverall. The same applies to the integration of socks in the coverall. This shortens the time needed to put on the protective suit even more compared with known protective suits. In addition, integration of the hood and socks in the coverall also avoids dangerous spots with regard to imperviousness.

In a further very advantageous execution of the invention, the at least one zipper extends beyond the hood and the hood divides into a rear part and a front part when the zipper is in the open state and hence, in the open state, can be laid down on the back and on the chest. It is merely necessary to ensure that the zipper used is impervious to the harmful substances and is also correspondingly imperviously connected to the coverall. One possible zipper of this kind is described for example in German Utility Model DE 201 10 132.7.

Advantageous developments and executions of the protective suit according to the invention will be apparent from the remaining subclaims and from the illustrative embodiment described hereinbelow in principle with reference to the drawing, where

DETAILED DESCRIPTION OF THE INVENTION

Figure 1:
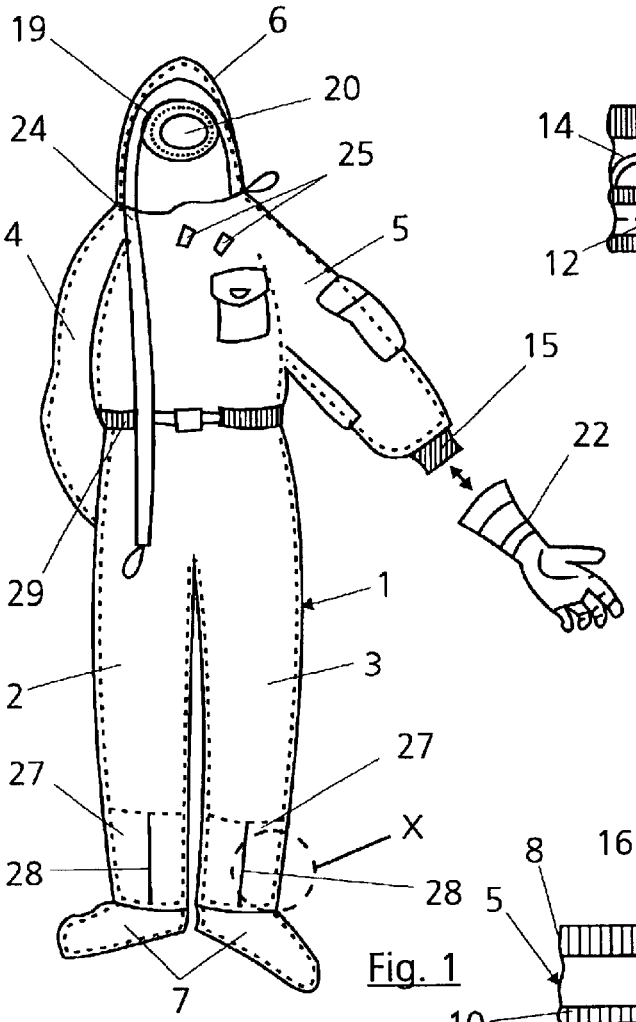
FIG. 1 shows an outline illustration of the protective suit according to the invention.

The protective suit consists of an coverall 1 having leg parts 2 and 3, sleeves 4 and 5, an integrated hood 6 and likewise integrated socks 7.

Figure 2:
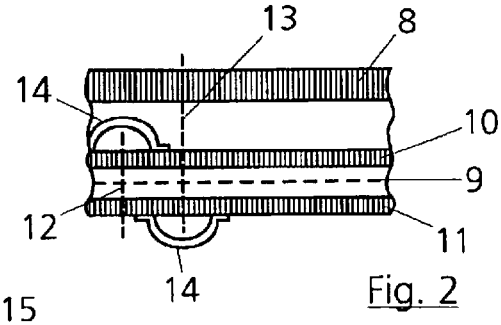
FIG. 2 shows an enlargement of the x marked excerpt in FIG. 1, featuring the outer according to the invention and the liner.

As can be seen in the enlarged representation in FIG. 2, the protective suit's outside is an outer 8. A wide range of materials can be used as the outer 8, such as, for example, polyamide, polyester, polyester-cotton blends and the like. When the protective suit is to be used in the military field, the outer 8 can additionally be provided with a camouflage layer or consist of incombustible material.

On the body-facing side of the outer 8 there is disposed, underneath same, a liner which is configured as a 3 ply laminate composed of a membrane 9 as a barrier layer, an outer protective layer 10 and an inner protective layer 11. The outer protective layer 10 can consist of breathable polyester and constitutes a mechanical protector for the membrane 9. The inner protective layer 11 can consist of polyamide and increases the wear comfort when rendered to be hydrophilic. Very useful for this purpose is, for example, velour polyamide, since it has an appropriate wicking action to transport perspiration away.

The membrane 9 is a cellulose-based material. Advantageously, it is pretreated by various washing operations in order that it may not shrink excessively later and so destroy the laminate construction.

Instead of cellulose, the membrane barrier layer can also be of polytetrafluoroethylene (PTFE), polyester or polyurethane and bear on the outside a protective layer against chemical and biological warfare agents. The membrane may also have on the inside a protective layer against abrasion and to increase the wear comfort. If desired, this protective layer can also be omitted.

The liner made up of the membrane 9 and the two protective layers 10 and 11 sits loosely inside the outer 8 and is only portionally stitched to the outer 8. The portional connection can be effected for example in the region of the socks 7, of the sleeve ends and in the region of the face opening field at the hood 6. FIG. 2 illustrates the stitching in these regions by way of example. A stitched seam 12 interconnects the 3 ply construction, while a further stitched seam 13 establishes the connection between the outer 8 and the liner. Since the two stitched seams 12 and 13 compromise the imperviousness, they have to be sealed by means of seam-sealing tapes 14, and these seam-sealing tapes 14 likewise have to be configured in such a way that they are impervious to the substances. As can be seen from FIG. 2, the stitched seam 13 is covered on the inside of the protective layer 11 by a seam-sealing tape 14. The stitched seam 12 is covered on the outside of the protective layer 10 by a seam-sealing tape 14. However, it is likewise possible for the seam-sealing tape 14 to be applied on the inside of the protective layer 11.

Figure 4:
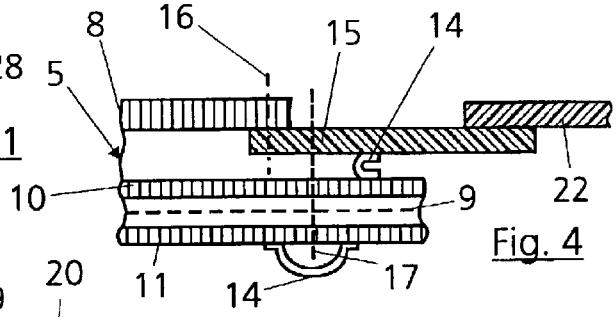
FIG. 4 shows a greatly enlarged section through the end part of a sleeve of the protective suit.

FIG. 4 shows a greatly enlarged section through the lower end of a sleeve 4 or 5 having an elastic end part 15. The end part 15 consists of butyl rubber and is stitched via a seam 16 to the outer 8 and via a seam 17 to the liner, consisting of membrane 9 and the two protective layers 10 and 11. To re-establish imperviousness, there is again a seam-sealing tape 14 on the inside of the protective layer 11 and a further seam-sealing tape 14 between the end part 15 and the outer protective layer 10.

Instead of by integration of the socks 7 in the coverall 1, the connection of the leg parts 2 and 3 to the socks 7 can be established in the same way as the connection of the ends of the sleeves 4 and 5, by elastic end parts 15 (not depicted).

Figure 5:
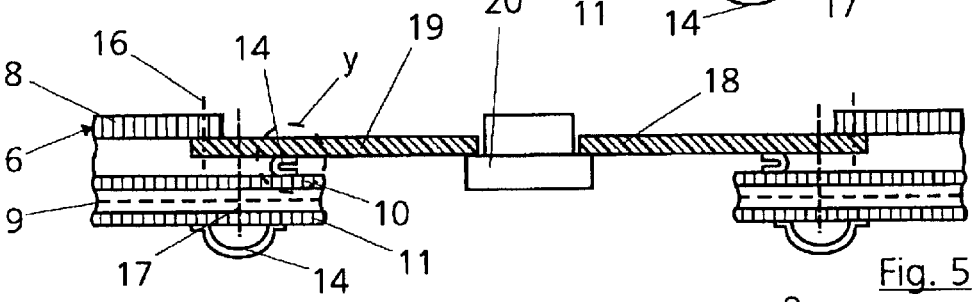
FIG. 5 shows a section through the head region of the protective suit in the region of the face opening in an enlarged representation.

FIG. 5 shows an enlarged representation of the region of the hood 6 featuring an open facial field 18. In the same way as at the end of the two sleeves 4 and 5, there is an elastic terminal part 19 of butyl rubber which is likewise connected by a stitched seam 16 to the outer 8 of the hood 6 and by a stitched seam 17 to the liner of the hood 6. Again, seam-sealing tapes 14 restore the sealing compromised by the stitched seams 16 and 17.

It is also evident from FIG. 5 that a merely schematically outlined protective mask 20 cooperates with the elastic terminal part 19, the facial region opening defined by the terminal part 19 being somewhat smaller than the protective mask 20 to ensure imperviousness in the facial region 18 also. In the same way, the elastic end part 15 at the end of each of the two sleeves 4 and 5 constitutes a sealing connection to a glove 22 which is likewise impervious to the harmful substances.

Figure 7:
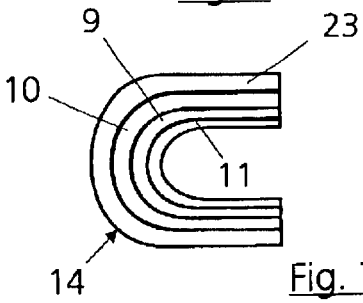
FIG. 7 shows an enlarged representation of the y-marked excerpt in FIG. 5, featuring a seam-sealing tape.

FIG. 7 shows a greatly enlarged depiction of the circle y in FIG. 5, showing the construction of a seam-sealing tape 14.

The seam seal in the form of a tape is likewise constructed as a 3 ply laminate, composed of a membrane 9 and inner and outer protective layers 10 and 11. Additionally, however, at least one of the two protective layers 10 or 11 have applied to it an adhesive layer 23 to establish, in each case, the connection to the layer to which the seam-sealing tape 14 is to be applied. This ensures sealing in the region of stitched seams.

FIG. 1 also shows a zipper 24 which starts on the right leg part 2 to the side of the gusset and extends laterally along the trunk over the hood 6 and ends on the left-hand side at the end of the neck. The zipper 24 can advantageously be opened and closed from both ends. To ensure appropriate imperviousness to the harmful substances, the zipper chosen has to be of appropriate imperviousness and, furthermore, an impervious connection to the outer 8 and to the liner has to be ensured.

Figure 3:
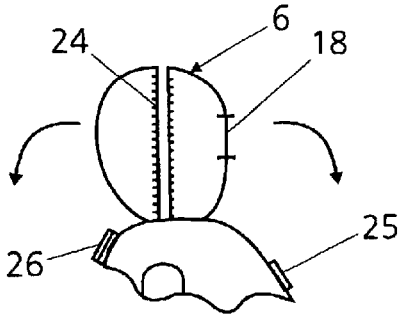
FIG. 3 shows a side view of the head region of the protective suit according to FIG. 1.

FIG. 3 shows how the zipper 24 extends through or above the hood 6. As a consequence, when the zipper 24 has been opened, the two parts of the hood can be laid down half on the back and half on the chest. FIG. 3 indicates, as an example of a fastening element, a hook and loop tape 25 which is situated in the interior of the suit and, when the suit is worn open, the rolled-up hood 6 can be fastened to the outside of the suit by means of a loop 20. The same design is conceivable for the back.

In the lower region, the coverall 1 can be provided, over the stockings 7, with cuffs 27 which may be equipped with zippers 28. The cuffs 27 prevent for example any ingress of water into the shoes of the person wearing the coverall 1.

Figure 6:
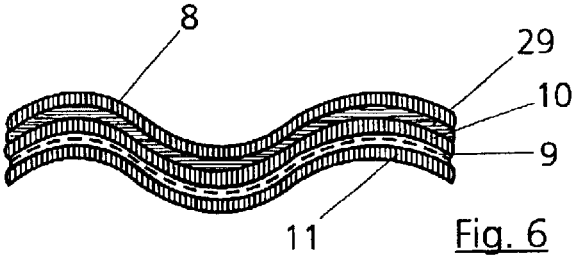
FIG. 6 shows a section through a region featuring an elastic band in an enlarged representation.

To adapt the coverall 1 better to the person who is to wear it, it can be equipped with one or more elastic bands 29 (see FIG. 1 and enlarged representation in FIG. 6). For instance, an elastic band 29 can extend over the back region of the coverall and, if desired, even reach as far as into the front region. For this purpose, one or more elastic bands 29 are accommodated on the outer 8 in drawstrings. The lining likewise has elastic bands attached to it which are sealed in the stretched state using a seam-sealing tape. In the loose state, all the layers (liner, elastic band, seam-sealing tape) will form a wave-shaped vault, whereby the coverall 1, given an appropriate degree of stretch, can be adapted to the circumference of the person wearing the coverall 1 (see FIG. 6).

The illustrated connection of the coverall 1 via the elastic end parts 19 and 15 of butyl rubber in the region of the hood 6 and in the region of the sleeve ends 4 and 5 is merely illustrative. It will be appreciated that other end parts or transitions are possible as well here. The essential point is merely that these end parts create an appropriately pervious connection to gloves 22 and to a protective mask 20.

Instead of a simple stitched connection 16 of the hood 6 to the end part 19, it will be appreciated that it is also possible to provide double seams or other connections to ensure appropriate imperviousness in the facial region between the hood 6 and a gasmask 20.

What is claimed is:

1. A protective suit for protection against harmful chemical and biological substances, comprising:

an outer shell; and a liner which is disposed underneath the outer shell; wherein the liner includes a breathable barrier layer blocking the inward passage of at least one of harmful chemical substances and biological substances and allowing the outward passage of water vapor; and wherein the protective suit is configured as an coverall wherein the barrier layer includes the breathable membrane surrounded on an inner side by an inner protective layer and on an outer side by an outer protective layer (10, 11).

2. The protective suit according to claim 1, wherein the coverall (1) is provided with a hood (6) which is integral with the coverall (1).

3. The protective suit according to claim 2, wherein at least one zipper (24) extends beyond the hood (6) and the hood (6) divides into a rear part and a front part when the zipper (24) is in the open state.

4. The protective suit according to claim 2, wherein the hood (6) terminates on a front side, which is provided with a face opening (18), with an elastic terminal part (19) which is impervious to the substances and which is connected to one of the outer shell (8) and the liner (9, 10, 11).

5. The protective suit according to claim 4, wherein the elastic material for the terminal part (19) is one of rubber and a rubberlike material.

6. The protective suit according to claim 5, wherein the elastic material is butyl rubber.

7. The protective suit according to claim 4, wherein the terminal part (19) is connected to both the outer shell (8) and the liner (9, 10, 11) by stitched seams (16, 17) which are impervious to the substances.

8. The protective suit according to claim 1, wherein the coverall (1) is provided with socks (7) which are integral with the coverall (1).

9. The protective suit according to claim 8, wherein cuffs (28) are provided over the stockings (7).

10. The protective suit according to claim 1, wherein the membrane (9) is combined with the inner and outer barrier layers (10, 11) to form a 3-ply laminate.

11. The protective suit according to claim 1, wherein the membrane (9) is provided with cellulose material.

12. The protective suit according to claim 1, wherein the membrane (9) comprises polytetrafluoroethylene.

13. The protective suit according to claim 1, wherein the membrane (9) comprises polyester.

14. The protective suit according to claim 1, wherein the membrane (9) comprises polyurethane.

15. The protective suit according to claim 1, wherein the two protective layers (10, 11) consist of either polyamide or polyester.

16. The protective suit according to claim 15, wherein the outer protective layer (10) consists of polyester which is breathable and the inner protective layer (11) consists of polyamide which has been rendered hydrophilic.

17. The protective suit according to claim 1, wherein the coverall (1) is provided with at least one zipper (24) which is stable and impervious to the substances.

18. The protective suit according to claim 1, wherein the liner, which consists of the membrane (9) and the protective layers (10, 11), is loose within the outer shell (8) and is only proportionally connected to the outer shell (8).

19. The protective suit according to claim 18, wherein the liner (9, 10, 11) is proportionally stitched to the outer shell (8), and the seams (12, 13, 16, 17) are sealed by seam-sealing tapes (14) which are impervious to the substances.

20. The protective suit according to claim 19, wherein the seam-sealing tapes (14) are each provided with a membrane (9) as a barrier layer against the substances which is surrounded on both a front and a rear side by a protective layer (10, 11), the protective layer (10 or 11), via which the connection to the liner (9, 10, 11) or to the outer shell (8) is effected, is provided with an adhesive layer (23).

21. The protective suit according to claim 1, wherein ends of at least one of arms (4, 5) and legs (2, 3) of the coverall (1) are provided with elastic end parts (15) which consist of a material which is impervious to the substances.

22. The protective suit according to claim 21, wherein the end parts (15) are made of one of rubber and a rubberlike material.

23. The protective suit according to claim 22, wherein the end parts (15) are made of butyl rubber.

24. The protective suit according to claim 1, wherein the coverall (1) is provided at least in a back region with at least one elastic band (29), and the elastic band (29), the outer shell (8), the liner (9, 10, 11) and the seam-sealing tapes (14) form a wave-shaped course in a loose state thereof.

25. A protective suit for protection against harmful chemical and biological substances, the protective suit comprising an outer shell and a liner which is disposed underneath the outer shell and is provided with a barrier layer against the substances;

wherein the protective suit is configured as an coverall (1), the barrier layer which has been incorporated into the liner being a membrane (9) which is surrounded on both sides by a protective layer (10, 11) each;

wherein the overall coverall (1) is provided with a hood (6) which is integral with the coverall (1);

wherein at least one zipper (24) extends beyond the hood (6) and the hood (6) divides into a rear part and a front part when the zipper (24) is in the open state; and wherein the hood (6), which is two part by virtue of the at least one zipper (24), is in the open state and foldable onto a back of the coverall (1) and onto a chest of the coverall (1) and is fixable on the back and on the chest by fastening mechanisms (25, 26).

26. The protective suit according to claim 25, wherein the fastening mechanisms are one of loops (26) and hook and loop tapes (15).

27. A protective suit for protection against harmful chemical and biological substances, comprising:

an outer shell; and a liner which is disposed underneath the outer shell, wherein the liner includes a breathable barrier layer blocking the inward passage of at least one of harmful chemical substances and biological substances and allowing the outward passage of water vapor; and wherein the protective suit is configured as an coverall, wherein the barrier layer includes the breathable membrane surrounded on an inner side by an inner protective layer and on an outer side by an outer protective layer, the coverall is provided with a hood which is integral with the coverall, and the coverall is provided with socks which are integral with the coverall.

* * * * *